United States Patent [19]

Semanchik et al.

[11] Patent Number: 4,493,334

[45] Date of Patent: Jan. 15, 1985

[54] WALKING AID

[76] Inventors: Stephen Semanchik, 21 Lance Cir., Bldg. G, Bridgeport, Conn. 06606; George Mezei, 640 W. 231st St., Bronx, N.Y. 10463

[21] Appl. No.: 429,111

[22] Filed: Sep. 30, 1982

[51] Int. Cl.[3] ..... A45B 9/00; A61H 3/00

[52] U.S. Cl. ..... 135/75; 135/84

[58] Field of Search ..... 135/65, 66, 75, 84, 135/DIG. 10, DIG. 11, 77, 67, 68, 69, 70, 71, 72, 73, 74, 76, 78, 79, 80, 81, 82, 83, 85, 86; 272/70.1, 70.2, 70.3, 70; D3/7, 8, 9; 248/155, 155.1, 155.2, 155.3, 155.4, 155.5

[56] References Cited

U.S. PATENT DOCUMENTS

| | | | |
|---|---|---|---|
| 2,189,429 | 2/1940 | Lundquist | 135/68 |
| 4,044,784 | 8/1977 | Smith | 135/67 |

FOREIGN PATENT DOCUMENTS

| | | | |
|---|---|---|---|
| 868652 | 2/1953 | Fed. Rep. of Germany | 135/75 |
| 2800872 | 7/1979 | Fed. Rep. of Germany | 135/DIG. 10 |
| 2420969 | 11/1979 | France | 135/75 |
| 1220589 | 1/1971 | United Kingdom | 272/70.1 |

*Primary Examiner*—Robert A. Hafer
*Assistant Examiner*—Arnold W. Kramer
*Attorney, Agent, or Firm*—Arthur T. Fattibene

[57] ABSTRACT

A walking aid which includes a shaft formed of nested telescoping sections which can be readily secured and locked in the adjusted position and which has connected to one end thereof a foot pad having an arcuate sole portion simulating an anatomical foot and a handle portion connected to the other end whereby the handle is constructed so that when grasped the bearing weight of the user is on the hypothermar eminence of the hand which is the anatomically weight bearing surface of the hand. The aid may be provided with one of several distinct handle arrangements which may function as a hand guard, provide illumination and/or arrange to be disposed relative to the foot pad to define and arc of a circle. The foot pad and connected shaft and handle are balanced so that the aid is naturally maintained in an upright position.

5 Claims, 18 Drawing Figures

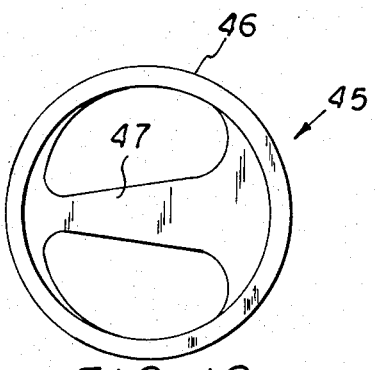
FIG. 10
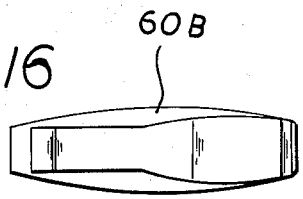
FIG 16
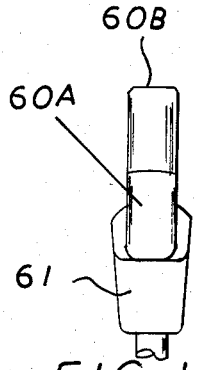
FIG. 18
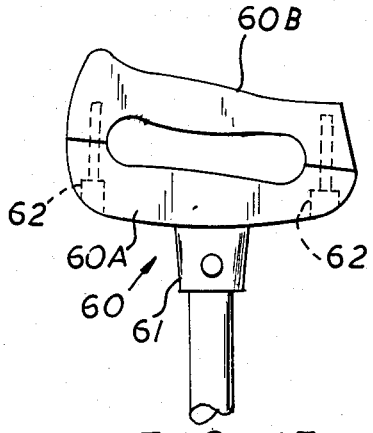
FIG 15
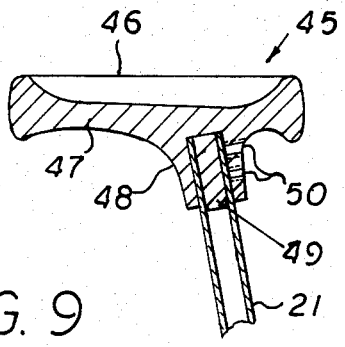
FIG. 9
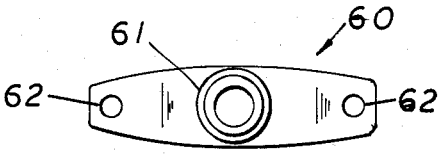
FIG. 17
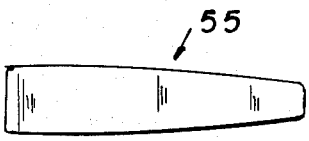
FIG. 12
FIG 14
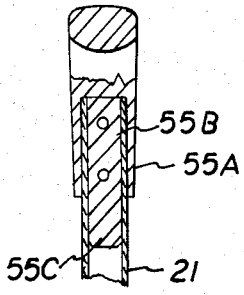
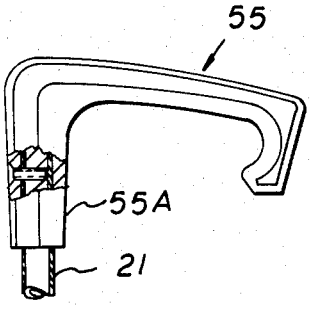
FIG. 11
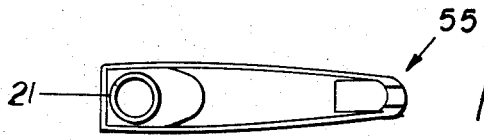
FIG. 13

WALKING AID

PROBLEM AND PRIOR ART

Heretofore, various efforts have been made to provide various types of walking aids to aid the old, the infirm or the handicapped person. Generally, such aids have taken the form of a cane which have a number of inherent disadvantages. Generally, such canes are formed with very narrow tips and common type handles which are not designed or constructed so as to position the hand of the user thereof so as to achieve the maximum strength with the minimum of effort. Consequently, for most old and infirm persons using such canes, it can become quite fatiguing and difficult. Also, such cane constructions are not self-standing and that when let go, such canes will fall. For certain infirm persons, this can be a considerable problem. Depending on the infirmity, some patients may not be able to bend over and retrieve such lost or knocked over cane.

To overcome some of the noted inherent disadvantages of a common cane, efforts such as disclosed in U.S. Pat. Nos. 504,326; 2,642,074; 2,782,796; 3,731,698; Des. 156,567 and Des. 187,450 have been made. While the structure of these known aids do provide some help to the old and/or infirm, the problem of fatigue is still present.

OBJECT

It is therefore an object of this invention to provide a walking aid for the aged and/or infirm which is specifically constructed so as to reduce fatigue on the patient when used during ambulation.

Another object is to provide a walking aid having an arcuate foot pad to simulate an anatomical foot.

Another object is to provide a walking aid which is rendered self-standing when not in use and thereby renders the aid immediately accessible to the old and infirm.

Another object is to provide a walking aid with a handle arrangement constructed so the wrist will naturally assume a normal radial deviation and extension, so as to minimize fatigue on the weight bearing wrist during ambulation.

Another object is to provide a walking aid with a handle construction which functions to utilize the efficiency of the natural tenodesis of the hand and the opponens pollicis muscle of the thumb.

Another object is to provide a handle construction which will function as a guard to protect the hand of the user from brushing upon some structure.

Another object is to provide a walking aid with a source of illumination.

BRIEF SUMMARY OF THE INVENTION

The foregoing objects and other features and advantages are attained by a walking aid which includes a shaft defined by nested sections which can be readily adjusted between an extended and distended length so as to accommodate patients of varying heights. A latch stop is provided to effect the relative adjustment of the respective sections and a locking collar is provided to secure the shaft in the adjusted position. Connected to one end of the shaft is an arcuate foot pad to simulate an anatomical foot. Connected to the other end of the shaft is a handle which is shaped so as to position the wrist in radial deviation and extension so that the weight of the user will naturally bear on the hypothenar eminence which is anatomically intended as the primary weight bearing surface on the hand. The arrangement of the handle relative to the foot pad is such that they fall on the arc of a circle.

In a given embodiment the handle construction may be formed with an annular guard to protect the hand of the user from brushing up against a building structure or the like. In another form, the handle may be formed to define a housing for an additional use such as illumination and such.

FEATURES

A feature of this invention resides in the provision when the aid defines a structure which resembles the functional movement of an anatomical foot by imitating the phases of a normal gait, i.e. head strike, foot flat and toe off.

Another feature resides in the provision wherein the aid is rendered self-standing.

Another feature resides in a handle construction which is sized and shaped to normally place the wrist of the user in radial deviation and extension for maximum weight bearing efficiency and with a minimum of fatigue.

Another feature resides in the provision wherein the arcuate foot pad provides for greater anterior-posterior and medial-lateral support so as to render the aid more secure during ambulation.

Another feature resides in the provision whereby the aid by rotation of the foot pad 90° may function as a support or crutch for a painful or weak foot.

Other features and advantages will become more readily apparent from the drawings and specifications in which:

FIG. 9 is a modified handle arrangement.

FIG. 10 is a plan or top view of FIG. 9.

FIG. 11 is another modifield handle construction.

FIG. 12 is a plan view of FIG. 11.

FIG. 13 is a bottom view of FIG. 11.

FIG. 14 is an end view of FIG. 11.

FIG. 15 is another modified handle construction.

FIG. 16 is a plan or top view of FIG. 15.

FIG. 17 is a bottom view of FIG. 15, and

FIG. 18 is an end view of FIG. 15.

DETAILED DESCRIPTION

Figure 1:
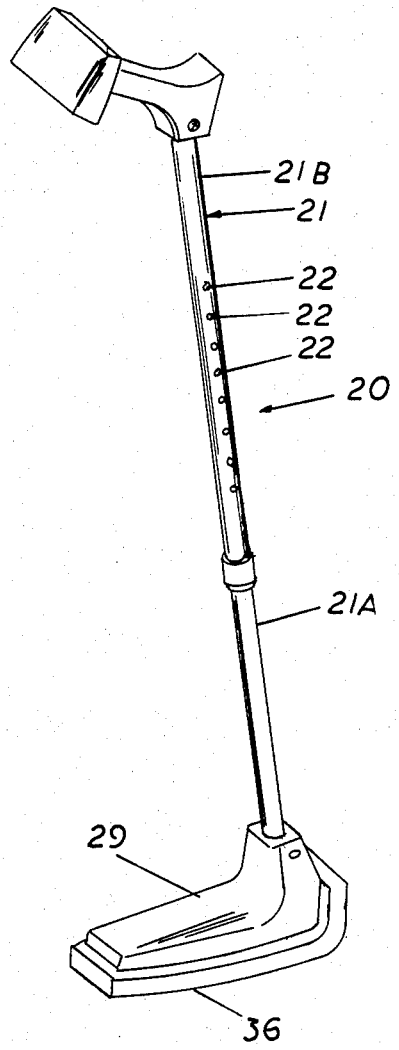
FIG. 1 is a perspective view of a walking aid embodying the invention.

Referring to the drawings, there is shown a walking aid embodying the invention. As shown in FIGS. 1 to 7, the embodiment thereof is directed to a walking aid 20 which comprises a shaft 21 consisting of nested sections 21A and 21B. In the illustrated embodiment 20, the lower section 21A is a tubular member which is slidably received within the upper section 21B. The respective sections 21A and 21B are slidably adjustable so that the length of the shaft 21 can be adjusted to the height of a given patient or user.

Figure 5:
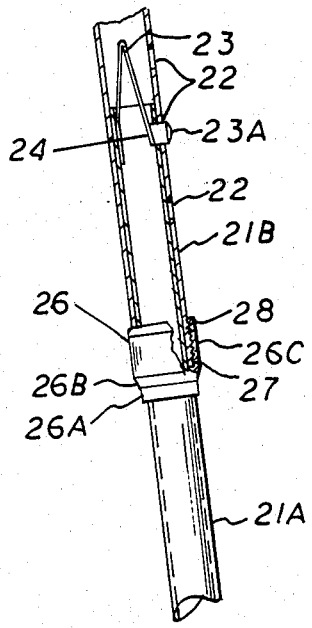
FIG. 5 is a sectional view taken on line 5—5 on FIG. 3.

Means are provided to effect the relative adjusted position of the respective sections 21A and 21B, and to secure the respective sections in their adjusted position. In the illustrated embodiment, the sections are rendered adjustable by providing the upper section 21B with a series of longitudinally spaced apertures 22. A latching member in the form of a reversely bent leaf spring 23 is fitted to the upper end of the lower section as best seen in FIG. 5. One end of the leaf spring is provided with a stop button 23A which is arranged to project through an opening 24 formed in the lower section 21A adjacent the upper end thereof. To effect adjustment of the respective sections, the stop button is depressed so as to permit the upper section to slide or telescope relative to the lower section until the appropriate aperture of the outer section 21B is disposed in alighment with the opening 24 of the lower section. When the appropriate aperture 22 of the upper section is disposed in alignment with opening 24 of the lower section, the stop button will latch or project through the aligned opening 24 and 22.

To positively secure the respective section in the adjusted position, a locking collar 26 is slidably mounted on section 21A. As shown, the locking collar 26 is provided with a reduced section 26A which slidably receives the lower shaft section 21A. The collar is provided with an intermediate tapered portion 26B which connects to an upper portion 26C which is provided with internal threads 27 which are adapted to mite with external threads 28 on the lower end of section 21B. By tightening the collar 26 to the threads of the upper sections, the two sections 21A and 21B are positively secured in their adjusted position.

Figure 8:
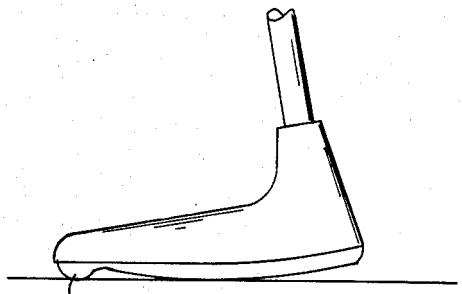
FIG. 8 is a modified foot pad construction.

In accordance with this invention, a foot pad 29 is connected to the bottom of the shaft 21. As shown, the foot pad 29 is provided with an arcuate sole portion 29A to simulate an anatomical foot. If desired, an anterior stop 30 may be provided adjacent the toe portion of the pad 29, as best seen in the modification of FIG. 8. The anterior stop 30, when used, will limit the rocking movement of the foot pad during ambulation.

Figure 4:
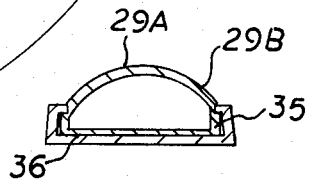
FIG. 4 is a detail sectional view taken on line 4—4 on FIG. 3.
Figure 6:
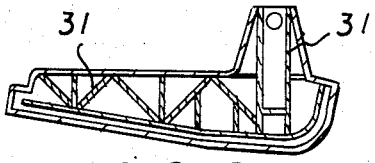
FIG. 6 is a sectional view taken on line 6—6 on FIG. 2.
Figure 7:
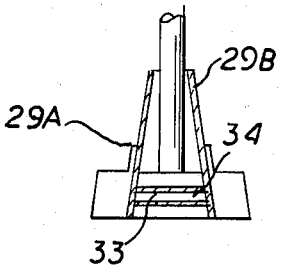
FIG. 7 is a sectional view taken on line 7—7 on FIG. 3.

As best seen in FIGS. 4, 6 and 7, th foot pad 29 may be fabricated as complementary, half sections, e.g. 29A and 29B, which are press fitted together to define the complete pad. The respective pad section 29A, 29B may be formed of suitable material, e.g. plastic or metal by casting or molding techniques wherein the respective sections are formed with internal webs or ribs 31 for strength as seen in FIG. 7 and with complementary pins 33 and sockets 34 for securing the two half sections 29A, 29B as shown in FIG. 7.

In the illustrated embodiment, the foot pad 29 is provided with a circumscribing lateral flange 35 to which an anti slip sole 36 is frictionally secured. It will be understood that the sole 36 is formed of a suitable anti-slip material such as rubber and the like.

Figure 2:
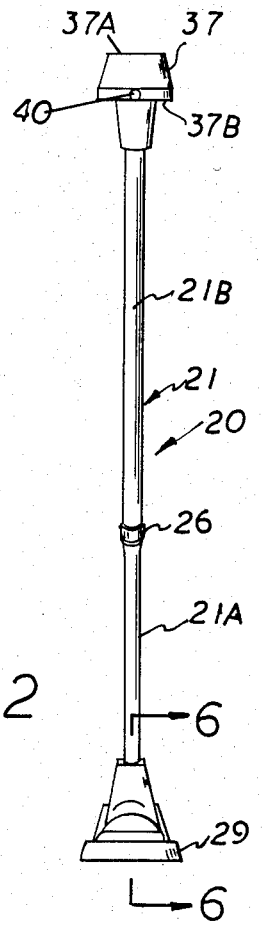
FIG. 2 is a front or anterior view of the aid aid of FIG. 1.
Figure 3:
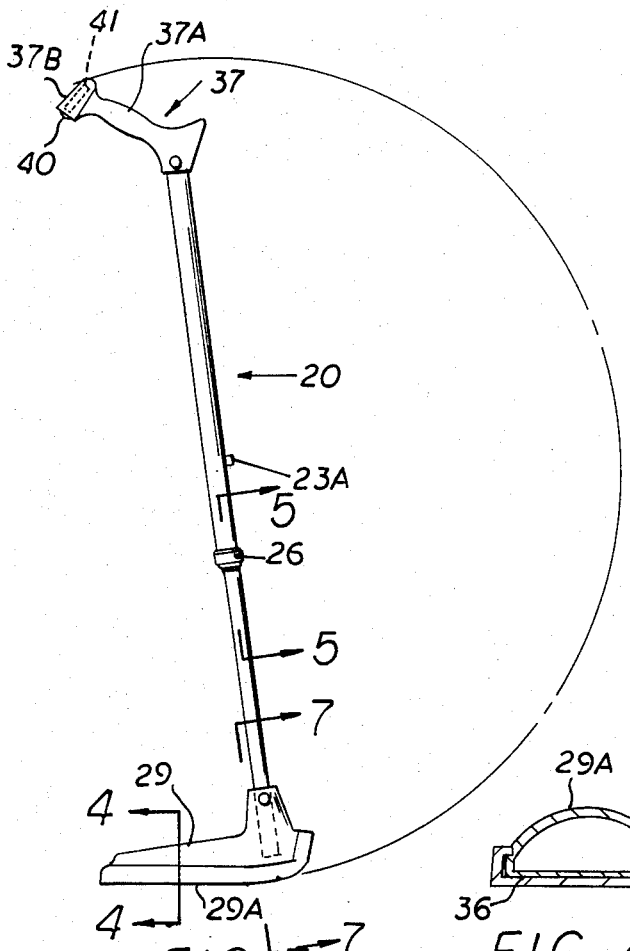
FIG. 3 is a side elevation view of FIG. 2.

Connected to the upper portion of the shaft 21 is a handle means 37. In the form of the invention shown in FIGS. 1 to 4, the handle means 37 projects anteriorly or in the direction of the foot pad 29. As best seen in FIGS. 1, 2 and 3, the handle means 37 inclines upwardly and is sized and shaped with a width sufficient to naturally position the wrist of the user in radial deviation and extension. Also, the handle means 37 is positioned relative to the foot pad 29 so that it is on the arc or complete diameter of a circle; as noted in FIG. 3. The arrangement is such that a "rocking movement" is provided that simulates the functional movement of an anatomical foot by imitating the phases of a normal gait such as heel strike, foot flat and toe off. The aid thus results in a more natural and rhythmical gait, than that provided by conventional canes or other known aids.

The roll over action provided by the described aid 20 results in a dynamic displacement of the weight bearing surface of the foot pad as ambulation proceeds. This motion provides for increased comfort for the user and a reduction of fatigue on the weight bearing upper extremity.

The foot pad is sufficiently wide and the aid balanced so that it will be rendered self standing when released by the user. Thus, the user is free to effect the release thereof at any time to perform functional activities which may require the use of both hands.

Also, the width and size of the foot pad 29 provides for greater anterior posterior and medial-lateral support which makes the aid more secure during ambulation. By rotating the foot pad 90°, the foot pad 29 can be used for a rest or support for a painful or weak foot.

The handle means 37, which is illustrated as an anterior projecting cantelever type handle is provided with a relatively wide intermediate portion 37A inclined so that the wrist is positioned so as to bear the weight primarily on the hypothenar eminence of the hand. The handle 37 is also constructed so as to utilize the efficiency of the natural tenodesis of the hand and the opponens pollicis muscle of the thumb. This structure makes the aid feel lighter and easier to use by a paretic (weak) hand as well as by a normal hand.

If desired, the forward end 37B of the handle may be formed to define a housing for receiving a source of illumination, e.g. a light bulb 40 connected in circuit to a power supply such as a battery 41.

FIGS. 9 and 10 illustrate a modified handle construction 45. In this form, the handle 45 comprises an endless or annular guard 46 which has a transversely extending handle portion 47 extending generally anteriorly as best seen in FIG. 9. As shown, the handle 45 has a hub portion 48 which is formed with an annular recess 49 for receiving the upper end of shaft 21. One or more fasteners 50 secures the hub 48 to the shaft 21. As shown in FIG. 10, the handle portion 47, which is grasped by the user, is constructed so as to minimize fatigue as hereinbefore described. The annular guard 46 functions to protect the hand of the user.

FIGS. 11 to 14 illustrate another modified handle construction 55. In this form, the handle 55 is provided with a cantelever type handle which projects posteriorly of the foot pad. As shown, the handle 55 has a hub portion 55A similar to that of FIG. 9, i.e. the hub 55A is provided with an annular recess 55B for receiving the end of shaft 21. The portion 55C of the hub 55A which defines the core of the annular recess 55B extends beyond the hub 55A to be received in the upper end of the tubular shaft 21.

FIGS. 15 to 18 illustrate another modified handle construction 60. In this form, the handle 60 is constructed of an upper and lower complementary sections 60A and 60B to define an endless type handle disposed in a vertical plane. Handle section 60A is provided with a hub 61 similar to the hub 48 of FIG. 9. Fasteners 62 secure the two handle sections 60A and 60B together. The upper handle portion 60B is shaped so as to be grasped by the user in a manner hereinbefore described.

It will be understood that the respective handle construction described can be interchangeably used with the shaft 21 and connected foot pad. While the invention has been described with respect to several embodiments, it will be understood and appreciated that variations and modifications may be made without departing from the scope or spirit of the invention.

For example, the shaft can be made of a single or unitary construction whereby adjustability can be achieved by providing the upper and lower end of the unitary shaft with a series of adjusting holes to which the handle and arcuate foot pad can be detachably connected thereto in a predetermined adjusted position, such as by a locking pin.

We claim:

1. A walking aid comprising:

an elongated shaft capable of supporting a person's weight, a foot pad simulating an anatomical foot having a toe portion, a heel portion, and an arcuate sole portion extending between said toe and heel portion, said shaft being fixedly connected to said foot pad at a point in line with said heel portion whereby said shaft is normally inclined upwardly and forwardly, a handle means connected to the upper end of said shaft, said handle means including a portion cantileverly supported on said shaft and projecting anteriorly of said shaft and upwardly of said shaft, said handle having a relatively wide intermediate portion inclined upwardly and forwardly so as to position the wrist of the user in radial deviation and extension and whereby the user's weight is distributed on the hypothenar emenince of the user's hand, and said handle means is positioned on said shaft relative to said foot pad so that said handle means together with the arcuate sole portion of said foot pad is on the arc of a circle to simulate the movement of an anatomical foot by imitating the phases of a normal gait such as a heel strike, foot flat and toe off, during use, and said foot pad and connected shaft and handle means being balanced so that said aid is naturally maintained in an upright position.

2. A walking aid as defined in claim 1 wherein said handle means includes an annular guard portion circumscribing said handle.

3. A walking aid as defined in claim 1 wherein said handle means includes an upper and lower section defining an annular member disposed in a vertical plane, and means for securing said handle sections together, said upper section having a width such that when grasped by the user, the varying weight of the user is on the hypothenar eminence which is the anatomically weight bearing portion of the hand.

4. A walking aid as defined in claim 1 and including an anterior stop on the acruate sole portion adjacent said toe portion of said foot pad.

5. A walking aid as defined in claim 1 wherein said elongated shaft includes a first and second section telescopically nested so as to render the length of said shaft readily adjustable, means for maintaining said sections in adjustable position, said latter means including a reversly bent spring latch having a stop button connected to one end thereof, said spring latch being retained in one section, said one section having an opening therein for accomodating said stop button, and said other section having a series of longitudinally spaced apertures adapted to be aligned with the opening of said one section whereby said stop button projects through said opening and aligned aperture so as to maintain said sections in adjusted position, and a locking means including a locking collar slidably mounted on one section and having an internal threaded portion, and said other section having a complimentary threaded portion whereby said sections are positively secured by threading said collar to said threaded portion.

* * * * *